United States Patent [19]

Dufresne

[11] 4,372,636

[45] Feb. 8, 1983

[54] BATTERY CONNECTOR

[75] Inventor: Raymond A. Dufresne, Phoenix, Ariz.

[73] Assignees: Terry R. Eberts; Herbert E. Haynes, Jr.; Matthew L. Ajeman, all of Phoenix, Ariz. ; S

[21] Appl. No.: 196,868

[22] Filed: Oct. 14, 1980

Related U.S. Application Data

[63] Continuation-in-part of Ser. No. 124,979, Feb. 27, 1980, and Ser. No. 135,348, Mar. 31, 1980, abandoned.

[51] Int. Cl.[3] ..... H01R 11/24

[52] U.S. Cl. ..... 339/237; 339/225

[58] Field of Search ..... 339/224–240, 339/115 R, 115 C, 116 R, 116 C

[56] References Cited

U.S. PATENT DOCUMENTS

| | | | |
|---|---|---|---|
| 2,217,798 | 10/1940 | Dunlap | 339/227 X |
| 4,294,505 | 10/1981 | Gaffney | 339/237 X |

FOREIGN PATENT DOCUMENTS

| | | | |
|---|---|---|---|
| 960458 | 10/1949 | France | 339/237 |
| 763087 | 12/1956 | United Kingdom | 339/115 R |
| 2009527 | 6/1979 | United Kingdom | 339/231 |

*Primary Examiner*—Eugene F. Desmond

*Attorney, Agent, or Firm*—Herbert E. Haynes, Jr.

[57] ABSTRACT

Battery connectors are disclosed for demountably attaching the conductive strands of a battery cable directly to the terminal post of an electric storage battery with the connectors being adapted to exert a pressurizing force which forms and holds a conductive contact between the conductive strands of the battery cable and the terminal post of the electric storage battery.

6 Claims, 10 Drawing Figures

BATTERY CONNECTOR

CROSS-REFERENCE TO RELATED APPLICATIONS

This application is a continuation-in-part of copending U.S. patent application Ser. No. 124,979, filed Feb. 27, 1980, entitled BATTERY CONNECTOR, and of copending U.S. patent application Ser. No. 135,348, filed Mar. 31, 1980, entitled CORROSION-PROOF BATTERY CONNECTOR, both by the same inventor, and abandoned.

BACKGROUND OF THE INVENTION

1. Field of the Invention

This invention relates to connectors and more particularly to improved connectors for demountably attaching a battery cable to the terminal post of an electric storage battery.

2. Description of the Prior Art

Most electrical storage batteries of the type used in association with generators or alternators driven by internal combustion engines for supplying electric current to starters, and other accessories of the engine, and to, for example, the various electrical components of an automotive vehicle are provided with upstanding tapered positive and negative terminal posts to which the required cables are clampingly attached. For many years, the clamping attachment of the cables has been accomplished by a split clamp formed of lead due to the inherent resistance of lead to acid induced deterioration. Briefly, this well known split clamp includes the lead body having a tapered hole formed therethrough to axialy receive the battery terminal post, and the lead body is split radially of the tapered hole to provide a pair of spaced ears. A cross-bore is formed transversely through the spaced ears for receiving an adjusting bolt which in cooperation with a suitable nut applies a squeezing pressure on the ears to reduce the internal diameter of the tapered hole for clamping engagement with the battery terminal post. The cable is attached to the lead body so that conductive contact between the conductors of the cable and the terminal post of the battery is made through the lead body of the split clamp.

The above described split lead clamp has been one of the most troublesome devices on an automotive vehicle both from mechanical and electrical standpoints. Since lead is a relatively soft metal, it is easily stretched or otherwise deformed and is easily fatigued, and as a result, these prior art clamps cannot tolerate much in the way of abuse which normally occurs when installing, removing and reinstalling the clamps.

When these split battery clamps become stretched, to the extend where the ears are touching each other, the clamp looses its clamping ability and loose connections result. Oftentimes the ears of the clamp will become deformed making it very difficult to tighten or loosen the adjusting bolt which can result in several problems. When the bolt cannot be properly tightened, loose connections result, and when the bolt cannot be loosened it can become extremely difficult to remove the clamp and batteries have been ruined by loosening or breaking of the terminal post resulting from attempts to remove a tight clamp. Deformed ears have all too often resulted in rounding of the nut and the head of the bolt and stripping of the threads.

Since the adjusting bolt and its associated nut cannot be made of lead, and must be formed of a harder metal, they are subject to acid induced deterioration and become heavily corroded which weakens them and also results in loosening and tightening problems.

In addition to the above mentioned and other mechanical problems of the prior art split battery clamps, they are also subject to electrical problems. A loose connection, of course, results in an increase in the resistance of the electric circuit and a consequent loss of power to the starter and other accessories. Even a clamp which appears to be tight can produce problems in that a corrosion build-up can occur between the terminal post and the internal surface of the clamp, and such corrosion will increase the resistance to current flow and in severe cases has been known to result in complete interruption of current flow in the circuit.

Therefore, a need exists for new and improved connectors for attaching battery cables to the terminal posts of electric storage batteries, with those connectors overcoming some of the problems and drawbacks of the prior art.

SUMMARY OF THE INVENTION

In accordance with the present invention, new and improved connectors are disclosed for directly attaching a battery cable to the terminal post of an electric storage battery. The various embodiments of the connector of the present invention are designed to exert a pressure induced conductive contact between the conductive strands of a battery cable and the terminal post to which it is to be attached. In other words, the conductive strands of a battery cable are placed in direct engagement with the terminal post of the battery and the connectors of the present invention are employed to exert a pressurizing force on the conductive strands and thereby produce and maintain a solid electrical connection therebetween.

By directly connecting the conductive strands of the battery cable to the terminal post of the electric storage battery in the above described manner, the prior art requirement that the battery clamps be formed of lead, for electrically coupling the strands of the battery cable to the terminal post of the battery, is eliminated. By such elimination of the requirement that lead be used to form the battery clamps, the prior art problems of clamp deformation, stretching, breakage, acid induced deterioration and corrosion are eliminated, or are at least substantially reduced.

Therefore, the connectors of the present invention are preferrably formed of a suitable resilient inert dielectric material such as nylon, hard rubber or any other suitable material.

In a first embodiment, the battery connector of the present invention includes a cup-shaped clamping body having a blind bore formed therein with a pair of diametrically opposed slits formed in its extending sidewall so that the sidewall is formed of two resilient deflectable semi-circular legs. One of the resilient deflectable legs is provided with a notch formed centrally in its extending edge by which the conductive strands of the battery cable are introduced into the blind bore of the cup-shaped body. The bore is a close tolerance fit with the terminal post of the battery so that by installing the cup onto the post the conductive strands of the battery cable will be in conductive contact with the periphery of the terminal post. A retainer means having a bore formed therein, the diameter of which substantially matches the outside diameter of the cup-shaped clamping body, is slidingly placed on the body to hold the resiliently deflectable legs thereof in the proper pressure exerting position.

In a second embodiment, a cup-shaped clamping body having a blind bore formed therein is molded or otherwise formed with an integral arcuate in cross-section deflectable leg within its blind bore so as to be offset toward one side thereof. The cup-shaped body is probided with a notch in the edge of its endless sidewall and the notch is located so as to be diametrically opposed to the offset deflectable leg. The conductive strands of the battery cable are introduced via the notch into the bore of the cup-shaped body so that when the body is slidingly placed on the terminal post of the battery, the conductive strands of the battery cable will be in conductive contact with one side of the terminal post, and the deflectable leg will be in bearing engagement with the diametrically opposed side of the terminal post. A suitable screw, such as of nylon, is threadingly carried in the endless sidewall of the cup-shaped body for exerting an inwardly directed force on the deflectable leg to form and hold a firm conductive contact between the conductive strands of the battery cable and the terminal post of the battery.

In a third embodiment, the connector includes a cup-shaped clamping body which is provided with a blind bore therein which is sized to provide an interference fit with the battery terminal post. The cup-shaped clamping body is notched on the edge thereof which circumscribes the bore so that the conductive strands may be introduced into the blind bore of the cup-shaped body via the notch. Driving of the cup-shaped body onto the battery terminal post will force the conductive strands of the battery cable into conductive contact therewith due to the interference fit of the body on the battery terminal post.

In a fourth embodiment, a body of suitable material, is formed with a first bore for axially receiving the terminal post of the battery, and a second, or cross-bore having its centerline tangent with respect to the circumference of the first terminal receiving bore. An internally threaded bore is formed in the body in the same plane as the cross-bore so as to normally intersect the cross-bore at its point of tangency. A battery cable is inserted into the cross-bore with its conductive strands transverse and offset with respect to the terminal post receiving bore so as to be in conductive contact with the terminal post when the terminal post is axially received in the terminal post receiving bore. A set screw is threadingly carried in the third bore of the body for exerting a pressurizing force on the conductive strands of the battery cable to hold them in firm conductive contact with the peripheral surface of the terminal post.

In yet another embodiment, a cup-shaped body is provided with an axial hole through which the battery terminal post is slidingly passed into an enlarged bore which provides an annular cavity which circumscribes the battery terminal post. The conductive strands of the battery cable are introduced into the annular cavity through a hole formed radially in the side of the cup-shaped body and the conductive strands are wrapped around the terminal post of the battery. The annular cavity is then filled with a compactable conductive material, such as granulated or shredded lead, or any other malleable material, which is subjected to compacting forces to form a solid mass which encapsulates the terminal post having the conductive strands of the battery cable wrapped therearound.

Accordingly, it is an object of the present invention to provide new and improved connectors for directly attaching the conductive strands of a battery cable to the terminal post of an electric storage battery.

Another object of the present invention is to provide new and improved connectors for directly attaching the conductive strands of a battery cable to the terminal post of an electric storage battery, with the connectors being inexpensive to fabricate and simple to use.

Another object of the present invention is to provide new and improved connectors which exert pressure on the conductive strands of a battery cable to firmly hold them in direct conductive contact with the terminal post of an electric storage battery.

Another object of the present invention is to provide new and improved connectors of the above described character which can be totally fabricated of inert materials to reduce the occurance of acid induced deterioration.

Still another object of the present invention is to provide new and improved connectors which can be formed of resilient inert dielectric material to reduce the occurance of corrosion build-up and acid induced deterioration.

The foregoing and other objects of the present invention, as well as the invention itself, may be more fully understood from the following description when read in conjunction with the accompanying drawings.

DESCRIPTION OF THE PREFERRED EMBODIMENTS

Figure 1:
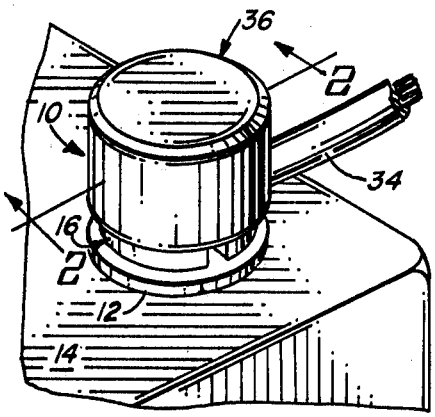
FIG. 1 is a perspective view of a first embodiment of the improved battery connector of the present invention.
Figure 2:
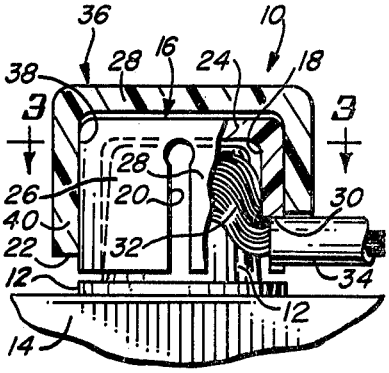
FIG. 2 is an enlarged sectional view taken along the line 2—2 of FIG. 1.
Figure 3:
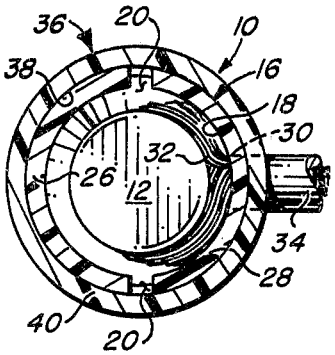
FIG. 3 is an enlarged sectional view taken along the line 3—3 of FIG. 2.

Referring more particularly to the drawings, FIGS. 1, 2 and 3 illustrate the first embodiment of the battery connector of the present invention, with this connector being indicated in its entirity by the reference numeral 10. Those same three figures also show the connector 10 as being installed on the well known tapered terminal post 12 of an electric storage battery 14 of the type commonly used, for example, in automotive vehicles.

The connector 10 has a body means which includes a clamping cap 16, preferably of cylindrical configuration, with a blind bore 18 formed axially therein. The sidewall of the clamping cap is formed with a pair of diametrically opposed slits 20 which extend axially from the edge 22, which circumscribes the opening of the blind bore 18, toward the closed top 24 of the cap so that the slits 20 divide the sidewall of the cap into an opposed pair of semi-circular in cross-section legs 26 and 28. The leg 28 is provided with a notch 30 formed centrally in its portion of the edge 22 so that the conductive strands 32 of a battery cable 34 may be introduced into the blind bore 18 of the cap 16.

To install the clamping cap 16 on the terminal post 12 of the battery, the conductive strands 32 are spread to a more or less flattened, or fanned-out state, within the blind bore 18 of the cap 10, and the cap is then axially pushed onto the terminal post 12 which repositions the more or less flattened array of conductive strands 32 so that they extend axially and wrap around approximately half of the peripheral surface of the terminal post. The blind bore 18 of the cap 16 is sized so that when the conductive strands 32 of the battery cable 34 are in the bore, in the manner hereinbefore described, and interference fit results which deflects the legs 26 and 28 somewhat and the natural resiliency of the cap 16, as will hereinafter be described, wil exert a counteracting force which firmly forces and holds the conductive strands 32 in conductive contact with the peripheral surface of the terminal post.

During installation of the cap 16, the conductive strands 32 will slide axially relative to the peripheral surface of the terminal post 12 and will provide a wiping action which cleans and reduces metal irregularities in the surface of the terminal post 12, and this results in an excellent conductive contact which is substantially gas tight to reduce occurence of corrosion build-up between the strands 32 and the post 12.

The material of which the clamping cap 16 is formed may, of course, be metal, but the preferred material is an electrically insulative and inert material in order to resist the deteriorating effects of the very hostile environment associated with the battery 14. In addition, the material should also resist creep, that is the slow change in its dimensions and configuration due to prolonged exposure to stress, and the material must also be resilient, that is, it must attempt to return to its natural state after deflection. Suggested materials possessing these desired characteristics are hard rubber, nylon, and the like.

As hereinbefore mentioned, the legs 26 and 28 of the clamping cap 16 will be deflected somewhat upon axial receipt of the battery terminal post 12 within the bore of the cap, and to prevent excessive creeping of these resiliently deflecting legs over a prolonged period of use, the body means of the connector 10 also includes a retainer cover 36 preferably of cylindrical configuration having a blind bore 38 axially formed therein. The diameter of the bore 38 is such that it closely matches the outside diameter of the clamping cap 16. When the retainer cover 36 is installed so that the clamping cap 16 is nestingly received in the bore 38 thereof, the endless sidewall 40 of the retainer cover 36 will circumscribingly hold the resilient deflectable legs 26 and 28 of the clamping cap 16 in place.

Although the retaining cover 36 is shown and described as being of cup-shaped configuration, it will be appreciated that the same objectives can be achieved with a simple ring-like structure (not shown).

Figure 4:
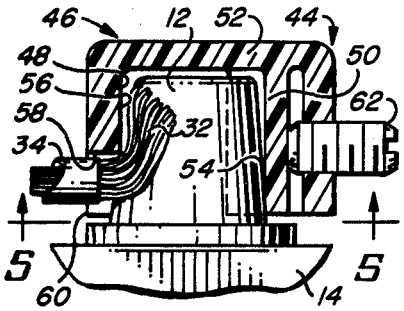
FIG. 4 is a vertical section taken through a second embodiment of the connector of the present invention illustrating the various features thereof.
Figure 5:
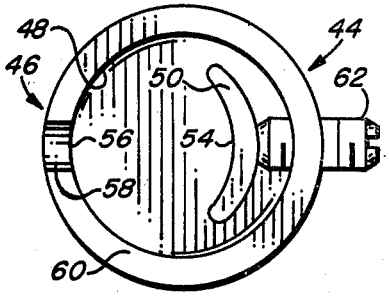
FIG. 5 is a bottom view taken along the line 5—5 of FIG. 4.

Referring now to FIGS. 4 and 5 wherein a second embodiment of the battery connector of the present invention is shown, with this second connector being indicated generally by the reference numeral 44. The connector 44, preferrably formed of the above described material, includes a connector body means in the form of a clamping cap 46, preferrably of cylindrical configuration, with a blind bore 48 formed therein. The cap 46, which may be molded, machined from stock materials, or otherwise formed, is provided with an arcuate in cross-section deflectable member 50, or leg, which is integral with the closed top 52 of the cap and extends therefrom into the blind bore 48. The deflectable leg 50 is offset toward one side of the blind bore, as seen best in FIG. 5, so that the distance between its inwardly facing concave surface 54 and the diametrically opposed portion 56 of the bore 48 is approximately equal to the diameter of the tapered battery terminal post 12. The clamping cap 46 is formed with a notch 58 in the edge 60 which circumscribes the opening of the blind bore 48, and that notch is located in that portion 56 of the sidewall of the cap which is diametrically opposed to the deflectable leg 50.

To install the battery connector 44, the conductive strands 32 of the battery cable 34 are introduced, in a flattened or fanned-out array, into the blind bore 48, and the cap 46 is slidingly pushed onto the terminal post 12. When the cap 46 is being installed in this manner, the conductive strands 32 will wipe the peripheral surface of the terminal post 12 and be repositioned so that they extend substantially axially of the terminal post and will wrap around approximately one half of the post. The relatively close tolerance fit of the deflectable leg 50 and the diametrically opposed portion 56 of the blind bore will exert a clamping force to pressurize the conductive strands 32 into conductive contact with the peripheral surface of the terminal post 12. This pressurizing force is augmented and held by a set screw 62, such as of nylon, which is threadingly carried in the sidewall of the cap 46 so that it can be brought into bearing engagement with the concave surface of the deflectable leg 50. In addition to augmenting the pressurizing force, the set screw 62 will prevent creeping of the deflectable leg 50.

Figure 6:
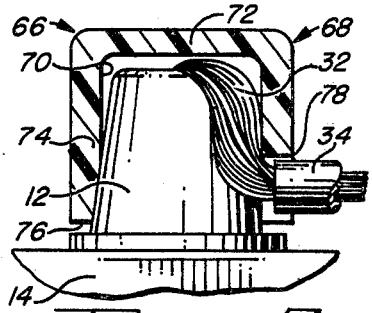
FIG. 6 is a vertical section, similar to FIG. 4, and showing a third embodiment of the improved battery connector of the present invention.

FIG. 6 illustrates a third embodiment of the battery connector of the present invention, with this connector being indicated in its entirity by the reference numeral 66. The connector body means of the battery connector 66 includes a clamping cap 68 which is preferrably formed of the hereinbefore described material, and is configured in a preferably cylindrical configuration having a blind bore 70 formed axially therein. The clamping cap 68 is defined by a closed top 72 with an integrally extending endless sidewall 74. The extending edge 76 of the endless sidewall 74 is formed with a notch 78 therein by which the fanned-out, or substantially flattened, conductive strands 32 of the battery cable 34 are introduced into the blind bore 70 of the clamping cap 68. The blind bore 70 of the cap 68 is sized to provide an interference fit with the terminal post 12 so that when the connector 66 is slidingly assembled on the terminal post, the strands 32 will wipe the post and be repositioned to substantially conform thereto and, the inherent resiliency of the cap 68 will exert a pressurizing force on the conductive strands.

It will be noted that the battery connectors 10, 44 and 66 described above can be easily sealed to protect the connection of the terminal post and the conductive strands from the corrosive battery environment. For example, complete sealing of this connection can be made by inserting an O-ring (not shown) in the gap between the connector body and the upper surface of the battery 14, or alternately, by filling that gap with a suitable material such as silicone grease or the like (not shown).

Figure 7:
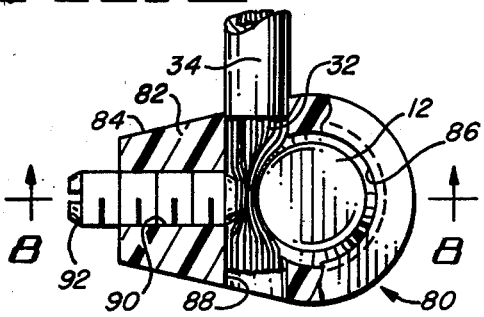
FIG. 7 is a plan view of another embodiment of the battery connector of the present invention which is partially broken away to illustrate the various features thereof.
Figure 8:
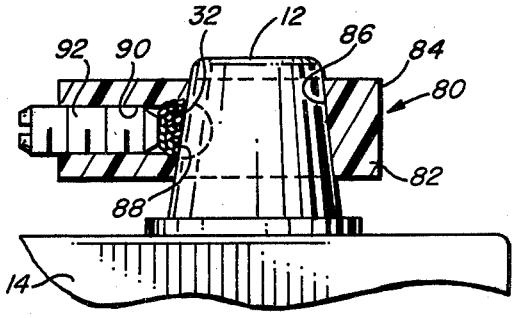
FIG. 8 is a sectional view taken along the line 8—8 of FIG. 7.

Referring now to FIGS. 7 and 8 wherein another embodiment of the battery connector of the present invention is shown with this embodiment being indicated generally by the reference numeral 80. In this embodiment, the connector body means of the connector 80 includes a block body 82 which is preferrably formed of the hereinbefore described material. The block body 82 is a substantially planar structure defined by an endless sidewall 84 and having a bore 86 formed to extend between the opposite planar surface thereof, with the bore 86 being sized to slidingly receive the battery terminal post 12 axially therein. A second, or cross-bore 88 is drilled or otherwise formed through the sidewall 84 of the block body 82 so that the centerline of this cross-bore 88 is tangential with respect to the circular cross-section, or circumference of the terminal post receiving bore 86. This cross-bore 88 is sized to receive the battery cable 34 and exposingly place the conductive strands 32 so that a portion thereof extends transversely through the bore 86 in an off-center position. When the block body 82 is slidingly assembled onto the terminal post 12, that portion of the conductive strands 32 which extend transversely through the bore 86 will wipingly engage the peripheral surface of the terminal post 12, and those strands will be forced out of the bore 86 and in response to this force will become very densely packed in the cross-bore 88. A third bore 90 is formed in the block body 82 so as to lie in the same plane as the cross-bore 88 and in a position so that it normally intersects the cross-bore at the point where its centerline is tangential to the circumference of the terminal post receiving bore 86. The third bore 90 is internally threaded and carries a set screw 92 therein, such as of nylon, which clampingly holds the conductive strands 32 in contact with the peripheral surface of the terminal post 12.

Figure 9:
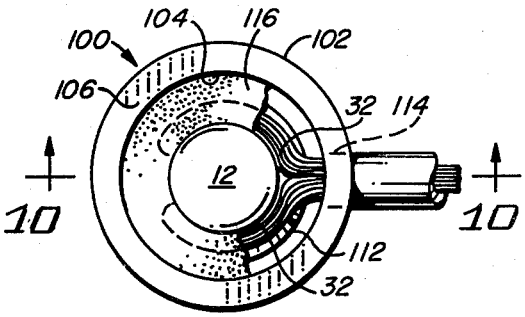
FIG. 9 is a plan view of still another embodiment of the battery connector of the present invention which is partially broken away to illustrate the various features thereof.
Figure 10:
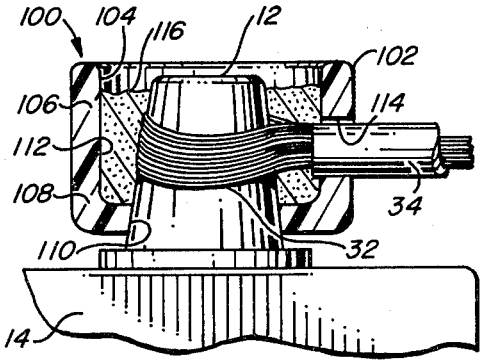
FIG. 10 is a sectional view taken along the line 10—10 of FIG. 9.

Referring now to FIGS. 9 and 10 wherein another embodiment of the battery connector of the present invention is shown, with this connector being indicated in its entirity by the reference numeral 100. The connector body means of the connector 100 includes a cup-shaped body 102 having an axial bore 104 formed therein which is defined by an endless sidewall 106 and a bottom 108 having a reduced diameter hole 110 formed therethrough which is coaxial with the bore 104. The hole 110 is sized so that it substantially matches the diameter of the tapered terminal post 12 which passes axially therethrough into the bore 104, and the bore 104 is sized to provide an annular cavity 112 which circumscribes the terminal post. The endless sidewall 106 of the cup-shaped body 102 has a radial hole 114 formed therethrough by which the conductive strands 32 of the battery cable 34 are introduced into the bore 104 of the body. The conductive strands 32 are placed so as to bearingly engage the peripheral surface of the terminal post 12 with this being preferrably accomplished by splitting the conductive strands into two substantially equal portions which straddle the post and are wound therearound in opposite directions. The annular cavity 112 is then filled with a compactable conductive material 116 such as granulated or shredded lead or any other highly malleable material. The malleable material is then tamped or otherwise subjected to compacting forces to form a solid mass which conforms to the interior of the annular cavity 112 and encapsulates the terminal post with the conductive strands 32 of the battery cable wrapped therearound.

While the principles of the invention have now been made clear in illustrated embodiments, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only of the true spirit and scope of the invention.

What I claim is:

1. A connector for direct attachment of the conductive strands of a battery cable to the terminal post of an electric storage battery comprising:

(a) connector body means having a bore for axially receiving the terminal post of the electric storage battery;

(b) means formed in said connector body means through which the conductive strands of the battery cable are introducable into the bore thereof for bearing engagement with the peripheral surface of the terminal post of the electric storage battery when the terminal post is axially received in the bore of said connector body means; and (c) said connector body means including means for exerting a pressurizing force to provide a conductive contact between the conductive strands of the battery cable and the terminal post when the conductive strands of the battery cable are introduced into the bore of said connector body means and the terminal post is axially received therein, said connector body means comprising:

(i) a clamping cap having the bore of said connector body means formed therein with the bore being blind, said clamping cap including a top from which at least a pair of resiliently deflectable legs extend with the legs configured to substantially circumscribe the blind bore formed in said clamping cap;

(ii) said clamping cap having a notch formed centrally in the extending edge of one of the pair of resilient deflectable legs thereof with said notch being said means through which the conductive strands of the battery cable are introducable; and (iii) said clamping cap having its blind bore sized so that when the conductive strands of the battery cable are introduced therein an interference fit is provided for the axial reception of the terminal post of the electric storage battery in the blind bore of said clamping cap.

2. A connector as claimed in claim 1 wherein said connector body means is formed of a dielectric material.

3. A connector as claimed in claim 1 wherein said connector body means is formed of a resilient inert dielectric material.

4. A connector as claimed in claim 1 wherein said connector body further comprises a retainer means demountably positionable on the peripheral surface of said clamping cap for retainingly engaging the resiliently deflectable legs thereof.

5. A connector for direct attachment of the conductive strands of a battery cable to the terminal post of an electric storage battery comprising:

(a) connector body means having a bore for axially receiving the terminal post of the electric storage battery;

(b) means formed in said connector body means through which the conductive strands of the battery cable are introducable into the bore thereof for bearing engagement with the peripheral surface of the terminal post of the electric storage battery when the terminal post is axially received in the bore of said connector body means; and (c) said connector body means including means for exerting a pressurizing force to provide a conductive contact between the conductive strands of the battery cable and the terminal post when the conductive strands of the battery cable are introduced into the bore of said connector body means and the terminal post is axially received therein, said connector body means comprising:

(i) a clamping cap having the bore of said connector body means formed therein with the bore being blind, said clamping cap including a top from which an endless sidewall integrally extends with the sidewall circumscribing the blind bore of said clamping cap;

(ii) said clamping cap having an arcuate in cross-section resiliently deflectable leg integrally extending from the top thereof into its blind bore with said resiliently deflectable leg being off set toward one side of the blind bore and having its concave surface facing inwardly;

(iii) said clamping cap having a notch formed in the extending edge of the endless sidewall thereof at a point which is diametrically opposed to said resiliently deflectable leg with said notch being said means through which the conductive strands of the battery cable are introducable into the blind bore of said clamping cap;

(iv) said clamping cap being configured with the distance between the concave surface of said resiliently deflectable leg and the diametrically opposed side of its blind bore being sized so that when the conductive strands of the battery cable are introduced therein an interference fit is provided for the axial reception of the terminal post of the electric storage battery in the blind bore of said clamping cap; and (v) a set screw threadingly carried in the endless sidewall of said clamping cap so as to extend radially into the blind bore of said clamping cap, said set screw threadingly movable into bearing engagement with the convex surface of said resiliently deflectable leg for movement restraining engagement therewith.

6. A connector for direct attachment of the conductive strands of a battery cable to the terminal post of an electrical storage battery comprising:

(a) connector body means having a bore for axially receiving the terminal post of the electric storage battery;

(b) means formed in said connector body means through which the conductive strands of the battery cable are introducable into the bore thereof for bearing engagement with the peripheral surface of the terminal post of the electric storage battery when the terminal post is axially received in the bore of said connector body means; and (c) said connector body means including means for exerting a pressurizing force to provide a conductive contact between the conductive strands of the battery cable and the terminal post when the conductive strands of the battery cable are introduced into the bore of said connector body means and the terminal post is axially received therein, said connector body means comprising:

(i) a clamping cap having the bore of said connector body means formed therein with the bore being blind, said clamping cap including a top from which an endless sidewall integrally extends with the endless sidewall defining the blind bore of said clamping cap;

(ii) said clamping cap having a notch formed in the extending edge of its endless sidewall with the notch being said means through which the conductive strands of the battery cable are introducable into the blind bore of said clamping cap; and (iii) said clamping cap having its blind bore sized so that when the conductive strands of the battery cable are introduced therein an interference fit is provided for the axial reception of the terminal post of the electric storage battery.

* * * * *